US005765393A

United States Patent [19]

Shlak et al.

[11] Patent Number: 5,765,393

[45] Date of Patent: Jun. 16, 1998

[54] CAPILLARY TUBE INCORPORATED INTO LAST PASS OF CONDENSER

[75] Inventors: Peter Shlak, Staten Island, N.Y.; George Premaza, Bell Meade, N.J.

[73] Assignee: White Consolidated Industries, Inc., Cleveland, Ohio

[21] Appl. No.: 864,163

[22] Filed: May 28, 1997

[51] Int. Cl.[6] ..... F25B 39/00

[52] U.S. Cl. ..... 62/507; 62/511; 62/527; 165/146

[58] Field of Search ..... 62/507, 511, 524, 62/525, 527; 138/44; 165/146, 150

[56] References Cited

U.S. PATENT DOCUMENTS

| | | | |
|---|---|---|---|
| 2,896,429 | 7/1959 | Karmazin | 62/515 |
| 2,950,608 | 8/1960 | Abbott | 62/511 |
| 3,030,782 | 4/1962 | Karmazin | 62/515 |
| 3,919,858 | 11/1975 | Garland et al. | 62/498 |
| 4,202,182 | 5/1980 | Kawashima et al. | 62/511 |
| 4,418,546 | 12/1983 | Buswell | 62/115 |
| 4,524,823 | 6/1985 | Hummel et al. | 165/174 |
| 4,535,600 | 8/1985 | Gelbard | 62/156 |
| 4,589,265 | 5/1986 | Nozawa | 62/527 |
| 4,651,539 | 3/1987 | Coloka | 62/504 |
| 4,679,410 | 7/1987 | Drayer | 62/524 |
| 5,269,158 | 12/1993 | Bitter et al. | 62/511 |
| 5,651,268 | 7/1997 | Aikawa et al. | 138/44 |

FOREIGN PATENT DOCUMENTS

| | | | |
|---|---|---|---|
| 24 36 248 | 2/1976 | Germany . | |
| 33 09 979 | 9/1984 | Germany . | |
| 6-272998 | 9/1994 | Japan | 165/147 |
| 826164 | 5/1981 | U.S.S.R. . | |
| 412 150 | 6/1934 | United Kingdom . | |

*Primary Examiner*—William F. Tapolcai
*Attorney, Agent, or Firm*—Pearne, Gordon, McCoy and Granger LLP

[57] ABSTRACT

A multipass evaporator for an air conditioner includes a pair of spaced-apart and parallel headers, a plurality of microchannels extending between and connected to the headers, at least one throttling microchannel extending between and connected to the headers, and at least two baffles provided within the headers. The baffles are located in the headers to divide the plurality of microchannels and the throttling microchannel into at least three passes. The three passes include a first pass, a last pass, and at least one intermediate pass between the first pass and the last pass. The first pass includes the throttling microchannel which provides a desired restriction to obtain constant enthalpy expansion so that no restriction device is required between a condenser and the evaporator. Alternate embodiments are disclosed wherein an intermediate pass includes a throttling microchannel to reduce the mean temperature difference of the evaporator, the last pass of a multipass condenser includes a throttling microchannel, and the first passes of at least two parallel, multipass evaporators are provided with throttling microchannels having different restrictions so that the evaporators have generally equal mean temperature differences during operation.

20 Claims, 4 Drawing Sheets

CAPILLARY TUBE INCORPORATED INTO LAST PASS OF CONDENSER

BACKGROUND OF THE INVENTION

The present invention generally relates to refrigeration systems and, more particularly, to multipass heat exchangers for refrigeration systems which have restriction devices incorporated therein.

A refrigeration system, such as an air conditioner, typically has a closed circuit through which a refrigerant undergoes a thermodynamic cycle. The circuit typically includes a compressor, a condenser, an expansion or restriction device, and an evaporator. The compressor raises the pressure of hot refrigerant vapor to an optimum pressure for the condenser. The condenser condenses the high-pressure hot refrigerant gas by transferring heat to an external heat exchange fluid such as outside air. The restriction device lowers the pressure of the high-pressure refrigerant liquid to an optimum pressure for the evaporator. The evaporator vaporizes the low-pressure refrigerant liquid by absorbing heat from surrounding air and as a result cools the surrounding air. The low-pressure hot refrigerant vapor then returns to the compressor and the cycle repeats.

The restriction device ensures that the refrigerant flows through and is heated within the evaporator in a controlled manner. The performance of the restriction device also plays a crucial role in the capacity of the refrigeration system. The restriction device is typically of simple construction and is most commonly a capillary tube. The capillary tube is typically a thin-walled copper tube of small diameter and long length which is coiled to reduce its size. The capillary tube is joined within a refrigerant line connecting the condenser and the evaporator and restricts the flow of refrigerant from the condenser to the evaporator. The refrigerant undergoes a frictional pressure drop along the length of the capillary tube.

The capillary tube is relatively inexpensive and easy to manufacture and assemble but has several shortcomings. The capillary tube occupies a relatively large space, and must be handled with care to avoid distortion because it is relatively fragile. Additionally, the capillary tube must be joined to a refrigerant line between the condenser and the evaporator which typically requires braze joints at the inlet and the outlet of the capillary tube. These joints are potential points of refrigerant leakage, add to the total pressure drop of the system, and add to the cost of the refrigeration system. Accordingly there is a need in the art for an improved refrigeration system which overcomes the problems associated with the capillary tube while maintaining the benefits of the capillary tube.

BRIEF SUMMARY OF THE INVENTION

The present invention provides a multipass heat exchanger which overcomes at least some of the above-noted problems of the related art. According to the present invention, a multipass heat exchanger includes a pair of spaced-apart and parallel headers, a plurality of channels extending between and connected to the headers, at least one throttling microchannel extending between and connected to the headers, and at least two baffles provided within the headers. At least one of the baffles is located in each of the headers to divide the plurality of channels and the at least one throttling microchannel into at least three passes. The at least three passes include a first pass, a last pass, and at least one intermediate pass between the first pass and the last pass. The throttling microchannel provides a desired restriction to obtain constant enthalpy expansion.

According to one embodiment of the present invention, the throttling microchannel is located in the first pass of the heat exchanger which is configured to operate as an evaporator. According to another embodiment of the present invention, the throttling microchannel is located in the last pass of the heat exchanger which is configured to operate as a condenser. According to yet another embodiment of the present invention, the throttling microchannel is located in an intermediate pass of the evaporator to reduce the mean temperature of the heat exchanger when using a nonazeotrope blend. According to another aspect of the present invention, the first passes of at least two parallel, multipass evaporators are provided with throttling microchannels that have different restrictions so that the evaporators have generally equal mean temperature (due to the pressure drop in the coil).

BRIEF DESCRIPTION OF THE SEVERAL VIEWS OF THE DRAWINGS

These and further features of the present invention will be apparent with reference to the following description and drawings, wherein.

DETAILED DESCRIPTION OF THE INVENTION

Figure 1:
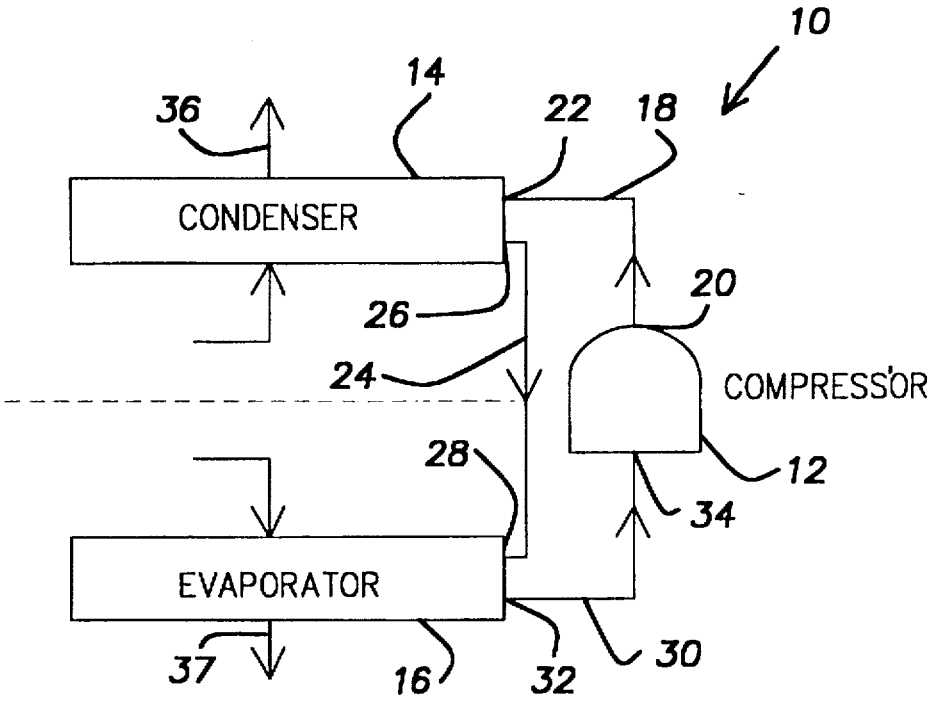
FIG. 1 is a diagrammatic view of a refrigeration system according to the present invention.
Figure 2:
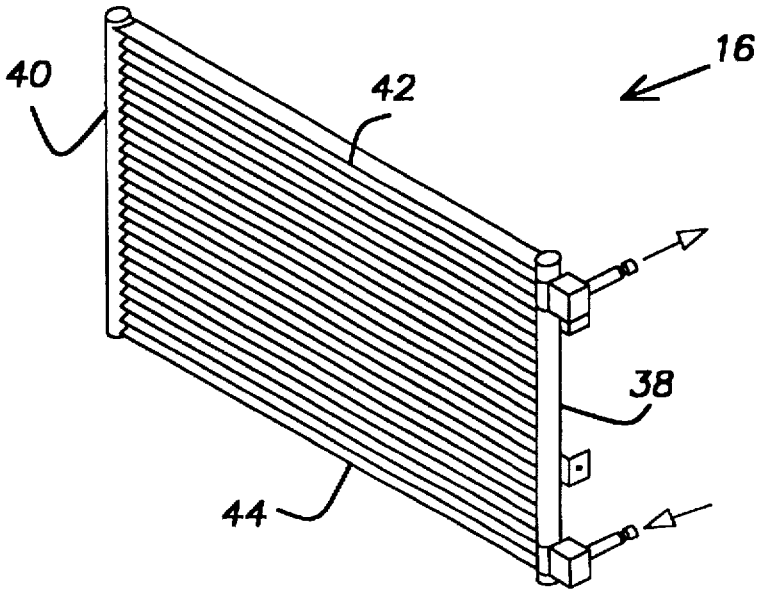
FIG. 2 is a prospective view of an evaporator of the refrigeration system of FIG. 1 having a throttling microchannel in a first pass.

FIG. 1 illustrates a refrigeration system 10 according to the present invention such as, for example, an air conditioner. The refrigeration system 10 includes a sealed or closed circuit having a compressor 12, a first heat multipass exchanger or condenser 14, and a second multipass heat exchanger or evaporator 16. A discharge line 18 connects an outlet 20 of the compressor 12 with an inlet 22 of the condenser 14. A refrigerant line 24 connects an outlet 26 of the condenser 14 with an inlet 28 of the evaporator 16. A suction line 30 closes the circuit by connecting an outlet 32 of the evaporator 16 with an inlet 34 of the compressor 12. The lines 18, 24, 30 are preferably metallic such as, for example, copper and are preferably joined by way of brazing.

A working fluid or refrigerant goes through a thermodynamic cycle as it passes through the circuit. The refrigerant leaves the compressor 12 as a vapor at an elevated pressure. The high-pressure refrigerant vapor passes through the discharge line 18 from the compressor 12 to the condenser 14. While passing through the condenser 14, the refrigerant vapor transfers heat to an external heat exchange medium 36, such as air, flowing over the condenser 14. The transfer of heat causes the refrigerant vapor to condense to liquid. The high-pressure refrigerant liquid passes through the refrigerant line 24 to the evaporator 16.

Within the evaporator 16, the high-pressure refrigerant liquid first passes through a restriction or capillary device where the refrigerant liquid undergoes a pressure drop and usually at least partially flashes to vapor. The pressure is reduced from optimum condenser pressure to optimum evaporator pressure. The low-pressure refrigerant liquid-vapor mixture then passes through the remainder of the evaporator 16 in a controlled manner where it is vaporized and usually superheated. Heat to support vaporization is absorbed from air 37 blown over the evaporator 16 so that the air 37 is cooled as desired. The superheated low-pressure refrigerant vapor passes through the suction line 30 from the evaporator 16 to the compressor 12. In the compressor 12, the pressure of the refrigerant vapor is again elevated and the above-described cycle repeats.

As best shown in FIGS. 2–6, the second multipass heat exchanger or evaporator 16 includes first and second manifolds or headers 38, 40, a plurality of evaporation channels 42, a calibrated throttling microchannel 44, and a plurality of fins 46. Each header 38, 40 is a cylindrical pipe having covers or plugs 48 at each end to form a hollow interior space or chamber 50, 52. The headers 38, 40 are preferably aluminum pipe. The inner sides of the headers 38, 40 are provided with parallel slots or openings at equal intervals along their length for receipt of ends of the channels 42 and the throttling microchannel 44. The channels 42 and throttling microchannel 44 are soldered or brazed to the headers 38, 40 to connect the headers 38, 40 and are in fluid-flow communication therewith. Connected in this manner, the headers 38, 40 are substantially parallel and spaced-apart by the channels 42 and the throttling microchannel 44. Typically, the headers 38, 40 are generally vertical so that the channels 42 and throttling microchannel 44 are generally horizontal but the headers 38, 40 can be generally horizontal so that the channels 42 and the throttling microchannel 44 are generally vertical.

The first header 38 is provided with three partitions or baffles 54 which divide the interior chamber 50 into four portions 50*a*, 50*b*, 50*c*, 50*d*. The first header 38 is also provided with an inlet pipe 56 near a first or lower end which is in fluid-flow communication with the first portion 50*a* of the interior chamber 50 and an outlet pipe 58 near a second or upper end which is in fluid-flow communication with the fourth portion 50*d* of the interior chamber 50. The second header 40 is provided with two partitions or baffles 60 which divide the interior chamber 52 into three portions 52*a*, 52*b*, 52*c*.

Figure 5:
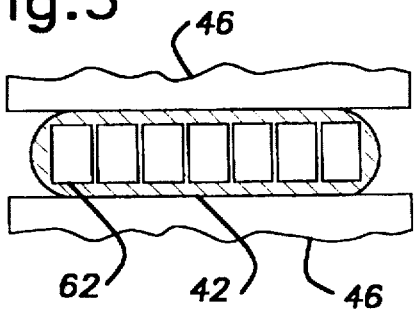
FIG. 5 is a cross-sectional view taken along line 5—5 of FIG. 3 showing a microchannel of the evaporator.

As best shown in FIG. 5, the evaporation channels 42 are preferably planar or flat so that they have a small profile in the direction of air flow. The illustrated evaporation channels 42 are microchannels having a plurality of longitudinally-extending internal fluid paths or passages 62 therein. The passages 62 are substantially parallel to one another. The illustrated evaporation channels 42 have seven passages 62 but fewer or more passages 62 can be utilized. The evaporation channels 42 are preferably extrusions and more preferably aluminum extrusions. The evaporation channels 42 are also preferably one-piece extrusions but alternatively can have separate dividers or inserts which form the plurality of passages 62.

Figure 6:
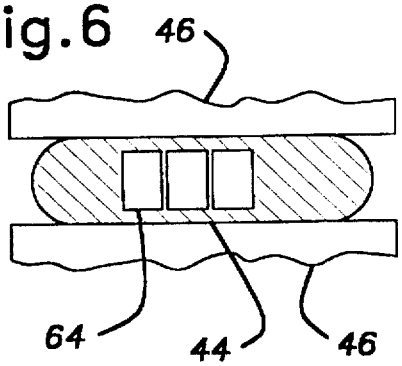
FIG. 6 is a cross-sectional view taken along line 6—6 of FIG. 3 showing the throttling microchannel of the evaporator.

As best shown in FIG. 6, the throttling channel 44 is preferably planar or flat so that it has a small profile in the direction of air flow. The illustrated throttling microchannel 44 has a plurality of longitudinally-extending internal fluid paths or passages 64 therein. The passages 64 are substantially parallel to one another. The illustrated throttling microchannel 44 has three passages 64 but fewer or more passages 64 can be utilized. It is noted however, that the throttling microchannel 44 will typically have fewer passages 62, 64 than the evaporation channels 42. The throttling microchannel 44 is preferably an extrusion and more preferably an aluminum extrusion. The throttling microchannel 44 is also preferably a one-piece extrusion but alternatively can have a separate divider or insert which forms the plurality of passages 64. The throttling microchannel 44 can be an extrusion which is separate and distinct from the extrusions of the evaporation channels 42 or can be the same extrusion as the extrusions of the evaporation channels 42 but having some of the passages 62 blocked or plugged.

The fins 46 are disposed between adjacent ones of the evaporation channels 42 and the throttling microchannel 44 and in contact therewith. The fins 46 can be serpentine, plate, or any other suitable type of fin. End plates 66 cover the top and bottom fins 46 to provide protection and rigidity. Note that the fins 46 can be eliminated in some refrigeration systems.

The baffles 54, 60 are positioned to form a refrigerant flow path with six passes in a "zig-zag" manner. The refrigerant travels into the first header 38 from the inlet pipe 56 and through the first pass from the first portion 50*a* of the first header 38 to the first portion 52*a* of the second header 40. The refrigerant then turns and travels through the second pass from the first portion 52*a* of the second header 40 to the second portion 50*b* of the first header 38. The refrigerant then turns and travels through the third pass from the second portion 50*b* of the first header 38 to the second portion 52*b* of the second header 40. The refrigerant then turns and travels through the fourth pass from the second portion 52*b* of the second header 40 to the third portion 50*c* of the first header 38. The refrigerant then turns and travels through the fifth pass from the third portion 50*c* of the first header 38 to the third portion 52*c* of the second header 40. The refrigerant then turns and travels through the sixth pass from the third portion 52*c* of the second header 40 to the fourth portion 50*d* of the first header 38 and out of the first header 38 through the outlet pipe 58. Alternatively, the evaporator 16 can be configured to have fewer or more passes. Note that in some instances the inlet and outlet pipes 56, 58 must be located on different headers 56, 58 in order to obtain an odd number of passes.

The first pass of the evaporator 16 has only the throttling microchannel 44. The first pass of the illustrated embodiment has a single throttling microchannel 44 but alternatively additional throttling microchannels can be used in the first pass. The quantity and size of the passages 64 within the throttling microchannel 44 are calibrated so that the throttling microchannel 44 restricts the flow of refrigerant therethrough to obtain a desired pressure drop and flow. The throttling microchannel 44 restricts the refrigerant to obtain constant enthalpy expansion. The pressure of the refrigerant gradually reduces over the length of the passages 64 as the refrigerant passes therethrough. In the first portion 50*a* of the first header 38 the refrigerant is at a high or condenser pressure and in the first portion 52*a* of the second header 40 the refrigerant is at a low or evaporator pressure.

The throttling microchannel 44 acts as a restricter valve or a capillary tube of a standard refrigeration system which both provide a constant enthalpy expansion process. Therefore, a restriction device such as a restricter valve or a capillary tube is not required in the refrigeration line 24 between the condenser 14 and the evaporator 16. As can be understood by one skilled in the art, the size and quantity of the passages 64 in the throttling microchannel 44 are optimized for the specific refrigeration system 10 being employed.

In the illustrated embodiment, the second through sixth passes of the evaporator 16 each have three evaporation channels 42. However, it is possible to have a larger or smaller number of evaporation channels 42 in each pass. It is also possible for some passes to have a different number of evaporation channels 42 than other passes, for the passes to have a progressively increasing number of evaporation channels 42, and/or for the evaporation channels 42 of the passes to have increasing quantities or sizes of passages 62.

No restriction device is located within the refrigerant line 24 between the condenser 14 and evaporator 16 because the throttling microchannel 44 is an integral part of the evaporator. The refrigerant line 24, therefore, can pass through a sump of the refrigeration system 10 to increase subcooling of the refrigerant and therefore to improve total output of the refrigeration system 10. The sump is typically filled with cold water which is condensation run-off from the evaporator 16. An additional advantage of the throttling microchannel 44 being an integral part of the evaporator 16 is that reheating of the refrigerant due to a relatively high ambient temperature, at the restriction device, is reduced or eliminated.

Figure 3:
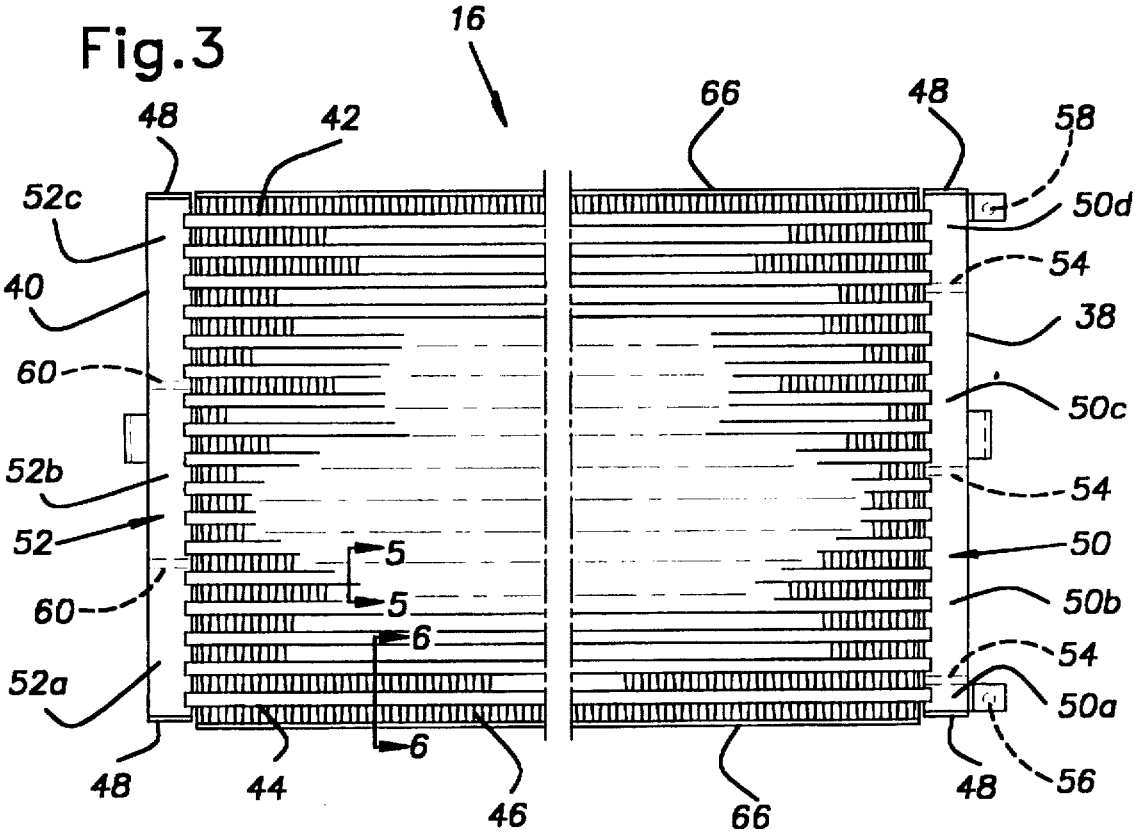
FIG. 3 is an elevational view of the evaporator of FIG. 2.
Figure 4:
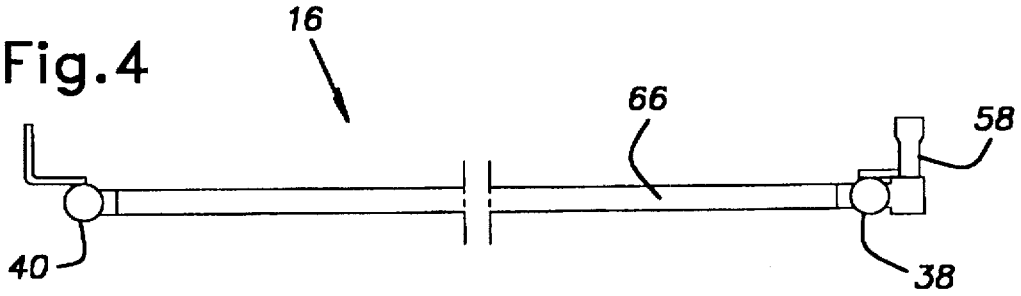
FIG. 4 is a plan view of the evaporator of FIG. 2.
Figure 7:
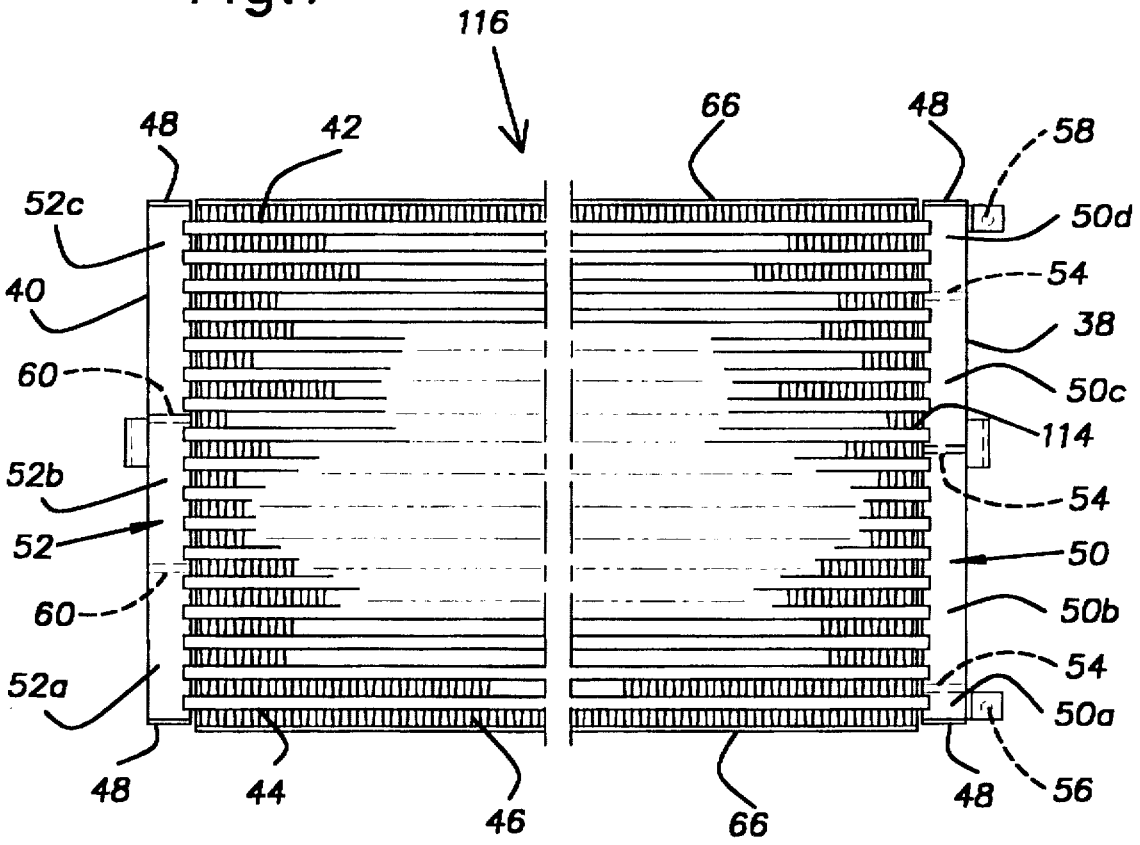
FIG. 7 is an elevational view of a variation of the evaporator of FIG. 3 having an additional throttling microchannel in an intermediate pass.

FIG. 7 illustrates an evaporator 116 which is a variation of the evaporator 16 of FIG. 3 wherein like reference numbers are used to identify like structure. The evaporator 116 is the same as the evaporator 16 of FIG. 3 except that the fourth pass of the evaporator 116 has an additional throttling microchannel 144. The illustrated embodiment has a single additional throttling microchannel 144 in a single pass but alternatively a greater number of additional throttling microchannels 144 can be used in the fourth pass of the evaporator 116, the additional throttling channel 144 can be located in a different intermediate pass, and/or additional throttling channels 144 can be located in more than one intermediate pass when there is a relatively large number of passes.

The quantity and size of the passages 64 within the additional throttling microchannel 144 are calibrated so that the additional throttling microchannel 144 restricts the flow of refrigerant to reduce the temperature of the refrigerant passing therethrough. The additional throttling microchannel 144 restricts the refrigerant to obtain constant enthalpy expansion. The pressure of the refrigerant gradually reduces and, once the refrigerant drops below saturation pressure, the temperature of the refrigerant also is gradually reduced.

Figure 8:
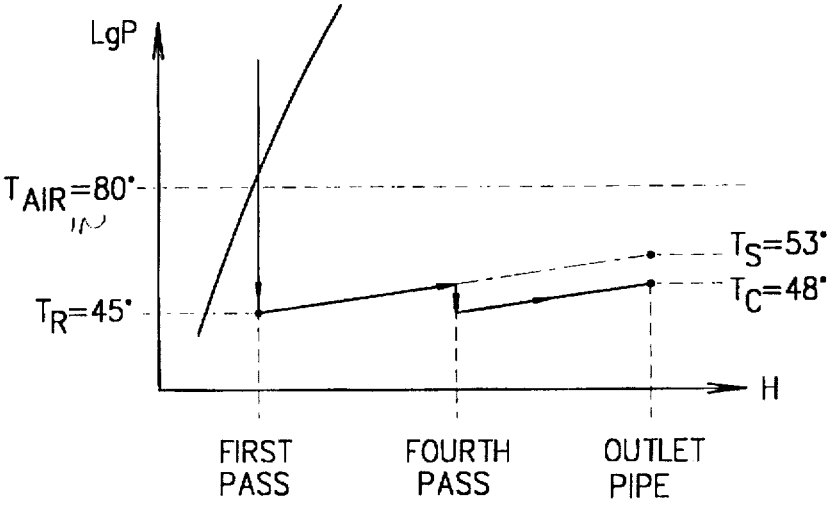
FIG. 8 is a graph illustrating the thermodynamic effect of the additional throttling microchannel of FIG. 7.

As best shown in FIG. 8, the temperature of the refrigerant gradually rises as it travels through the second and third passes of the evaporator 116 and absorbs heat from the air 37 passing over the evaporator 116. Due to this rise in temperature, the temperature difference between the air 37 and the refrigerant is gradually reduced. When the refrigerant passes through the additional throttling microchannel 144 in the fourth pass, however, the temperature of the refrigerant is reduced by a desired amount. The temperature of the refrigerant is preferably reduced back to the temperature of the refrigerant as it exited the throttling microchannel 44 of the first pass to obtain the same temperature difference between the air 37 and the refrigerant.

The temperature of the refrigerant again gradually rises as it travels through the fifth and sixth passes of the evaporator 116 and absorbs heat from the air 37. Due to this rise in temperature, the temperature difference between the air 37 and the refrigerant is again gradually reduced. It can be seen, however, that the additional throttling microchannel 144 reduces the average temperature of the refrigerant and therefore increases the mean temperature difference MTD= $T_{AIR}$—$TR_R$.

The additional throttling microchannel 144 is particularly advantageous in refrigeration systems utilizing nonazeotropic blends of refrigerant, such as R407C, which have relatively large glides. The illustrated example shows that R407C can have a glide of 7–9 degrees F. (from about 45 degrees F. after the first pass to about 53 degrees F. at the outlet pipe when the air temperature is about 80 degrees F.). With the additional throttling microchannel 144, however, the glide is reduced to about 3 degrees (from about 45 degrees F. after the first pass to about 48 degrees F. at the outlet pipe when the air temperature is about 80 degrees F.

Figure 9:
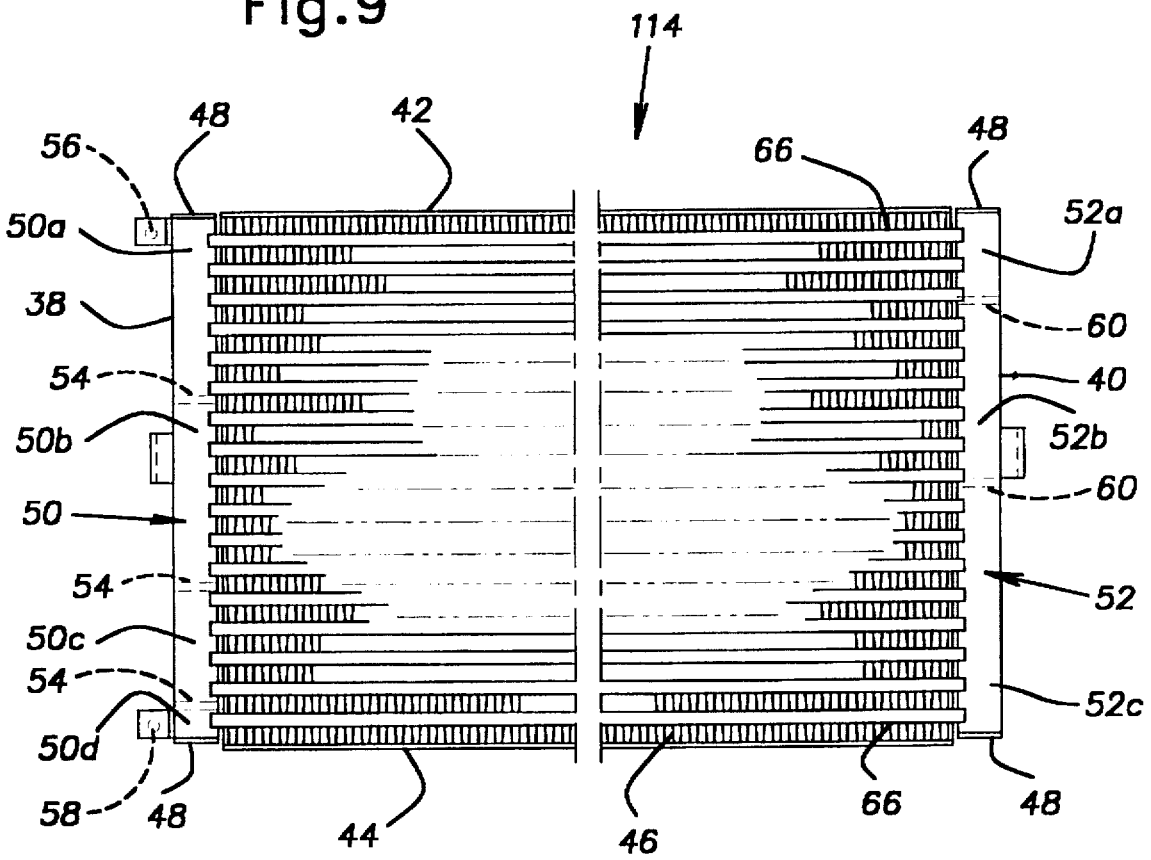
FIG. 9 is an elevational view of an alternative embodiment of the condenser having a throttling microchannel.

FIG. 9 illustrates a condenser 114 for an alternative embodiment of the refrigeration system 10 of FIG. 1 wherein like reference numbers are used to identify like structure. The condenser 114 illustrates that a throttling microchannel 44 can be located in the last pass of the condenser 114. The throttling microchannel 44 of the condenser 114 can be instead of or in addition to the throttling microchannel 42 in the first pass of the evaporator 16. The condenser 114 is constructed in the same manner as discussed above for the evaporator 16 of FIG. 3 except that it is configured for the refrigerant to flow in the opposite direction.

The throttling microchannel 44 is an integral part of the condenser 114 and located at the bottom of the condenser 114. The condenser 114, therefore, can be in the sump of the refrigeration system 10 to increase subcooling of the refrigerant and therefore to improve total output of the refrigeration system 10 and to reduce flash gas in the evaporator 16. The sump is typically filled with cold water which is condensation run-off from the evaporator 16.

Figure 10:
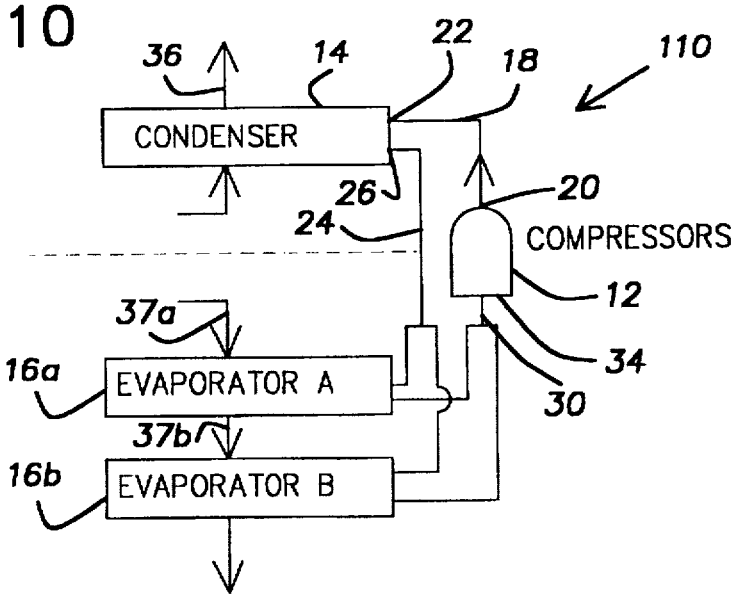
FIG. 10 is diagrammatic view of an alternative embodiment of the refrigeration system of FIG. 1.

FIG. 10 illustrates a refrigeration system 110 which is another alternative embodiment of the refrigeration system of FIG. 1 wherein like reference numbers are used to identify like structure. The refrigeration system 110 is the same as the refrigeration system of FIG. 1 except that more than one evaporator **16*a*, 16*b* is utilized. While the illustrated embodiment has two evaporators 16*a*, 16*b*, a greater number of evaporators 16*a*, 16*b*** can be utilized.

The evaporators **16*a*, 16*b* are arranged so that the air 37 consecutively flows over the evaporators 16*a*, 16*b* to simulate a counterflow-type heat exchanger. In the illustrated embodiment the evaporators 16*a*, 16*b* are parallel and facing each other. With the evaporators 16*a*, 16*b* arranged in this manner, the temperature of the air 37*b* reaching the second evaporator 16*b* is lower than the temperature of the air 37*a* reaching the first evaporator 16*a* because the air 37*b* has been cooled by the first evaporator 16*a*. Therefore, the throttling microchannels 42 of the evaporators 16*a*, 16*b* are calibrated to have different resistances to obtain different temperatures. The microchannel 42 of the second microchannel 16*b* is calibrated to reduce the temperature of the entering refrigerant to a level lower than the microchannel 42 of the first evaporator 16*a* to account for the fact that the temperature of the air is dropping as it flows over the evaporators 16*a*, 16*b*. The different calibrations of the throttling microchannels 42 enable the evaporators 16*a*, 16*b*** to have generally equal MTDs.

It can be readily seen from the above description that the present invention provides a refrigeration system which is compact, reduces the number of brazing joints, reduces the number of parts, reduces the total pressure drop because there are fewer joints, and reduces the use of costly materials such as copper. Additionally, the present invention provides a refrigeration system which has a restriction which can be easily standardized, has improved performance with non-azeotropic blends of refrigerant, and can have counterflow-type heat exchangers.

Although particular embodiments of the invention have been described in detail, it will be understood that the invention is not limited correspondingly in scope, but includes all changes and modifications coming within the spirit and terms of the claims appended hereto.

What is claimed is:

1. A multipass heat exchanger comprising:

a pair of spaced-apart and parallel headers;

a plurality of channels extending between and connected to said headers, each of said channels in fluid communication with each of said headers;

a throttling microchannel extending between and connected to said headers, said throttling microchannel in fluid communication with each of said headers and having a desired restriction to obtain constant enthalpy expansion; and at least two baffles provided within said headers, at least one of said baffles located in each of said headers to divide said plurality of channels and said throttling microchannel into at least three passes, said at least three passes including a first pass, a last pass, and at least one intermediate pass between said first pass and said last pass.

2. The multipass heat exchanger according to claim 1, wherein said first pass includes said throttling microchannel.

3. The multipass heat exchanger according to claim 2, wherein only said first pass includes a throttling microchannel.

4. The multipass heat exchanger according to claim 2, wherein said headers, said plurality of channels, said throttling microchannel, and said baffles are configured to operate as an evaporator.

5. The multipass heat exchanger according to claim 1, wherein said last pass includes said throttling microchannel.

6. The multipass heat exchanger according to claim 5, wherein only said last pass includes a throttling microchannel.

7. The multipass heat exchanger according to claim 5, wherein said headers, said plurality of channels, said throttling microchannel, and said baffles are configured to operate as a condenser.

8. The multipass heat exchanger according to claim 1, wherein said intermediate pass includes said throttling microchannel.

9. The multipass heat exchanger according to claim 8, wherein said headers, said plurality of channels, said throttling microchannel, and said baffles are configured to operate as an evaporator.

10. The multipass heat exchanger according to claim 1, wherein said throttling microchannel is an extrusion.

11. The multipass heat exchanger according to claim 1, wherein each of said plurality of channels is a microchannel having a plurality of parallel fluid passages therein, said throttling microchannnel has at least one fluid passage therein, and said throttling microchannel has fewer fluid passages than each of said plurality of channels.

12. A multipass evaporator for an air conditioner, said multipass evaporator comprising:

a pair of spaced-apart and parallel headers;

a plurality of channels extending between and connected to said headers, each of said microchannels in fluid communication with each of said headers;

a throttling microchannel extending between and connected to said headers, said throttling microchannel in fluid communication with each of said headers and having a desired restriction to obtain constant enthalpy expansion; and at least two baffles provided within said headers, at least one of said baffles located in each of said headers to divide said plurality of channels and said throttling microchannel into at least three passes, said at least three passes including a first pass, a last pass, and at least one intermediate pass between said first pass and said last pass, wherein said first pass includes said throttling microchannel.

13. The multipass evaporator according to claim 12, wherein each of said plurality of channels is a microchannel having a plurality of parallel fluid passages therein, said throttling microchannel has at least one fluid passage therein, and said throttling microchannel has fewer fluid passages than each of said plurality of channels.

14. The multipass evaporator according to claim 12, wherein said intermediate pass has another throttling microchannel.

15. The multipass evaporator according to claim 14, wherein each of said plurality of channels is a microchannel having a plurality of parallel fluid passages therein, each of said throttling microchannel and said another throttling microchannel have at least one fluid passage therein, and each of said throttling microchannel and said another throttling microchannel have fewer fluid passages than each of said plurality of channels.

16. A refrigeration system comprising:

a compressor having an inlet and an outlet;

a condenser having an inlet connected to said compressor outlet and an outlet; and at least one multipass evaporator having an inlet connected to said condenser outlet and an outlet connected to said compressor inlet, said multipass evaporator comprising:

a pair of spaced-apart and parallel headers;

a plurality of channels extending between and connected to said headers, each of said channels in fluid communication with each of said headers;

a throttling microchannel extending between and connected to said headers, said throttling microchannel in fluid communication with each of said headers and having a desired restriction to obtain constant enthalpy expansion; and at least two baffles provided within said headers, at least one of said baffles located in each of said headers to divide said plurality of channels and said throttling microchannel into at least three passes, said at least three passes including a first pass, a last pass, and at least one intermediate pass between said first pass and said last pass, wherein said first pass includes said throttling microchannel.

17. The refrigeration system according to claim 16, wherein said intermediate pass includes another throttling microchannel.

18. The refrigeration system according to claim 16, wherein there are at least two multipass evaporators which are arranged for consecutive flow thereacross.

19. The refrigeration system according to claim 18, wherein said throttling microchannel in said first pass of each of said at least two multipass evaporators provides a different restriction so that said at least two multipass evaporators have generally equal mean temperature differences during operation.

20. A refrigeration system comprising:

a compressor having an inlet and an outlet;

a multipass condenser having an inlet connected to said compressor outlet and an outlet, said multipass condenser comprising:

a pair of spaced-apart and parallel headers;

a plurality of channels extending between and connected to said headers, each of said channels in fluid communication with each of said headers;

a throttling microchannel extending between and connected to said headers, said throttling microchannel in fluid communication with each of said headers and having a desired restriction to obtain constant enthalpy expansion; and at least two baffles provided within said headers, at least one of said baffles located in each of said headers to divide said plurality of channels and said throttling microchannel into at least three passes, said at least three passes including a first pass, a last pass, and at least one intermediate pass between said first pass and said last pass, wherein said last pass includes said throttling microchannel; and an evaporator having an inlet connected to said condenser outlet and an outlet connected to said compressor inlet.

* * * * *